US005966099A

United States Patent [19]

Xue

[11] Patent Number: 5,966,099

[45] Date of Patent: Oct. 12, 1999

[54] ADAPTABLE DIRECTIONAL ANTENNA FOR HAND-HELD TERMINAL APPLICATION

[75] Inventor: Hongxi Xue, Forest, Va.

[73] Assignee: Ericsson Inc., Research Triangle Park, N.C.

[21] Appl. No.: 08/807,775

[22] Filed: Feb. 28, 1997

[51] Int. Cl.[6] ..... H01Q 1/24; H01Q 1/52

[52] U.S. Cl. ..... 343/702; 343/841

[58] Field of Search ..... 343/702, 841; 455/90, 117, 128

[56] References Cited

U.S. PATENT DOCUMENTS

| | | | |
|---|---|---|---|
| 5,373,304 | 12/1994 | Nolan et al. | 343/841 |
| 5,507,012 | 4/1996 | Luxon et al. . | |
| 5,550,552 | 8/1996 | Oxley | 343/702 |
| 5,666,125 | 9/1997 | Luxon et al. | 343/841 |
| 5,694,137 | 12/1997 | Wood | 343/702 |

FOREIGN PATENT DOCUMENTS

| | | |
|---|---|---|
| 0 689 297 | 12/1995 | European Pat. Off. . |
| 42 21 121 | 10/1993 | Germany . |
| 44 38 435 | 5/1996 | Germany . |
| 2 301 228 | 11/1996 | United Kingdom . |
| WO 95 01010 | 1/1995 | WIPO . |
| WO 96 05682 | 2/1996 | WIPO . |

OTHER PUBLICATIONS

Database WPI, Week 9750, Derwent Publications Ltd., London, GB; AN 97–536769, XP002071667 & CN 1 127 942 A (WANG LEI), Jul. 31, 1996, see Abstract.

*Primary Examiner*—Don Wong
*Assistant Examiner*—Hoang Nguyen
*Attorney, Agent, or Firm*—Nixon & Vanderhye P.C.

[57] ABSTRACT

A directional antenna assembly includes a reflector and a director disposed on opposite sides of an antenna radiator element to minimize body loading effects and thereby maximize available antenna gain. The radiator is disposed in a first casing, and the reflector and director are disposed in a second casing selectively enageable with the first casing. In one arrangement, the position of the reflector and director relative to the user is adjustable to accommodate the position of the communications terminal relative to the user. In other arrangements, the directional structure is selectively enageable and disengageable with the antenna radiator.

20 Claims, 3 Drawing Sheets

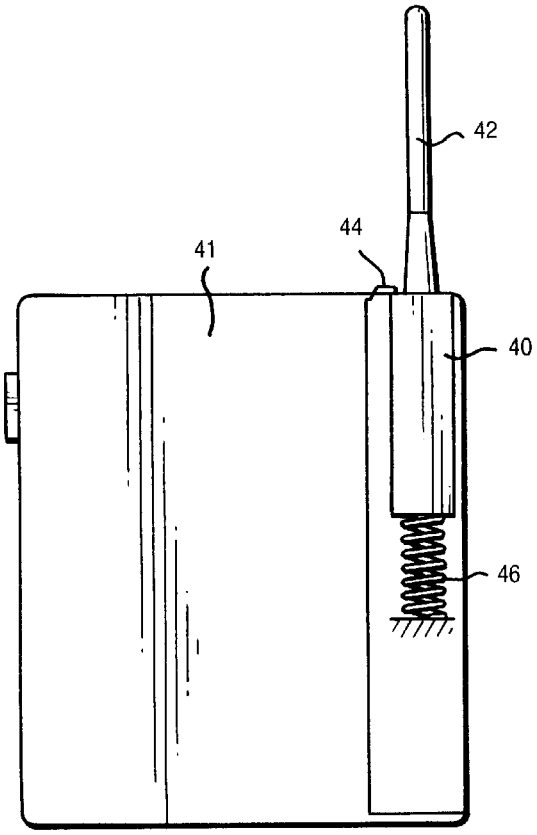
Fig. 6
Fig. 5
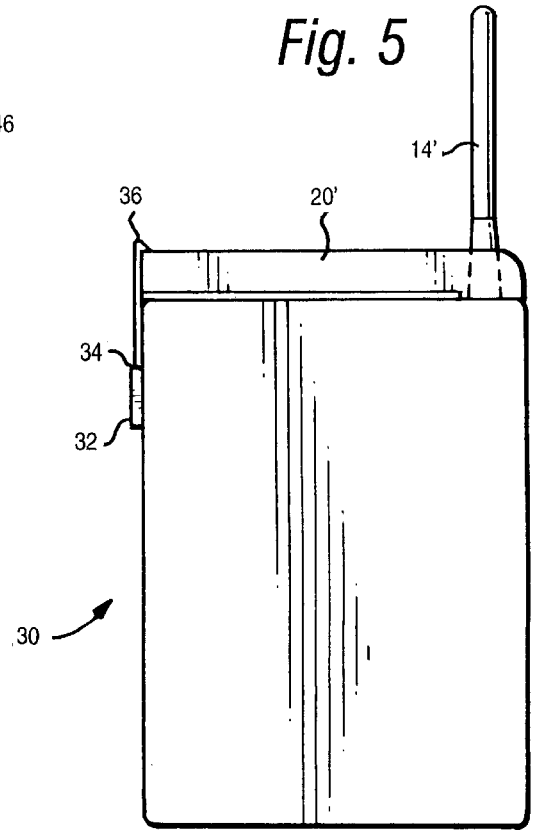

ADAPTABLE DIRECTIONAL ANTENNA FOR HAND-HELD TERMINAL APPLICATION

BACKGROUND OF THE INVENTION

The present invention relates to antennas for communications devices and, in particular, to an adaptable directional antenna enabling selective application and positioning of the directional structure.

On typical hand-held communication terminals, there is provided a single omni-directional antenna, which can be a monopole, dipole or variants thereof. These antennas, however, have a fundamental limitation in that when held close to a user, the antenna beam pattern gets distorted and the available antenna gain is reduced.

There has been a move toward the use of directional antennas in an effort to minimize body loading effects. FIG. 1 illustrates a cross-section of a directional antenna for communications terminal applications including a radiator element mounted in a casing along with a director and a reflector. One example of a directional antenna is disclosed in U.S. Pat. No. 5,507,012, the disclosure of which is hereby incorporated by reference. The antenna structure helps to concentrate the electromagnetic (EM) energy in a certain direction, such as away from the user. By doing this, the antenna can achieve additional gains over conventional antennas. In this context, however, the position of the communications terminal relative to the user is not fixed, for example, when the user is speaking on the phone and when the user attaches the phone to a belt or the like, and the antenna is therefore not consistently working effectively for its designed purposes.

SUMMARY OF THE INVENTION

The present invention attempts to overcome the drawbacks associated with the conventional fixed directional terminal antenna. In this context, because the center element is the only active radiation element, a separate casino can be formed to include the reflector and the director. The casing can also be configured to rotate around the central radiating element, thereby allowing the antenna peak radiation lobe to be changeable. Alternatively, the casing including the reflector and director can be selectively engageable with the active radiation element, enabling use of the directional antenna structure only as needed.

In preferred embodiments according to the invention, there is provided an antenna for a communications device, including a radiator mounted in a first casing for sending and receiving an RF signal, a reflector mounted in a second casing and a director mounted in the second casing. The first casing and the second casing are selectively engageable with each other. The second casing may include a hole therethrough defining an inside perimeter. In this regard, an outside perimeter of the first casing is provided with a predetermined shape such as an oval, and the inside perimeter of the second casing is shaped substantially corresponding to the predetermined shape. The first casing and second casing may be rotatable between two discrete positions by virtue of the predetermined shape. In the context of the first and second casings, the radiator is preferably molded in the first casing, and the reflector and director are preferably molded in the second casing.

In one arrangement, the second casing is molded from a bendable thermoplastic material, and the second casing, the reflector and the director are displaceable between a bent retracted position, in which the second casing is disengaged from the first casing, and an extended position, in which the second casing is engaged with the first casing. In this context, the reflector preferably comprises a spring metal sheet.

In another arrangement, the second casing is substantially U-shaped having sides and a connector between the sides defining an opening therebetween. The first casing in this context is selectively disposed in the opening. An outside perimeter of the first casing is provided with a predetermined shape, and the opening in the U-shaped second casing is preferably shaped substantially corresponding to the predetermined shape.

In accordance with another aspect of the invention, there is provided a communications device including a device housing, a printed circuit board (PCB) mounted in the housing, and the antenna according to the invention. The antenna is coupled with the PCB. In this context, the second casing, the reflector and the director may be displaceable between a bent retracted position, in which the second casing is disengaged from the first casing, and an extended position, in which the second casing is engaged with the first casing.

The device may further include an actuation button such as a PTT or a SEND button or the like secured to the device housing and coupled with the PCB. The button has a lock member coupled therewith, wherein the second casing, the reflector and the director are releasably securable in the bent retracted position by the lock member. In this regard, the button and the lock member preferably define opposite sides of a rocking lever such that when the button is pressed, the lock member is deflected from a locked position to an unlocked position, thereby releasing the second casing, the reflector and the director.

In another arrangement, the second casing, including the reflector and the director, is displaceable between a retracted position in which the second casing is disposed within the device housing and an extended position in which the second casing is disposed surrounding the first casing. A lock member may be provided secured to the device housing. The lock member is releasably engagable with the second casing to thereby lock the second casing in the retracted position. With this arrangement, a spring may be disposed engaged with the second casing to urge the second casing toward the extended position

BRIEF DESCRIPTION OF THE DRAWINGS

These and other aspects and advantages of the present invention will be described in detail with reference to the accompanying drawings, in which:

FIG. 5 illustrates a communications terminal that includes structure enabling selective application of the antenna directional structure; and FIG. 6 illustrates another embodiment communications terminal enabling, selective application of the antenna directional structure.

DETAILED DESCRIPTION OF PREFERRED EMBODIMENTS

Figure 1:
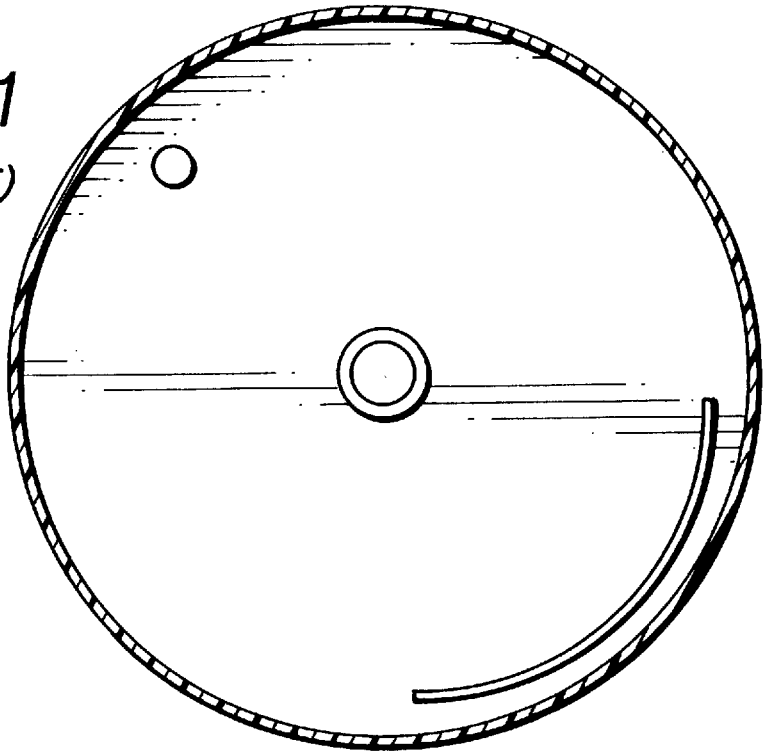
Fig. 1 (PRIOR ART)
FIG. 1 is a cross-sectional view of a directional antenna.
Figure 2:
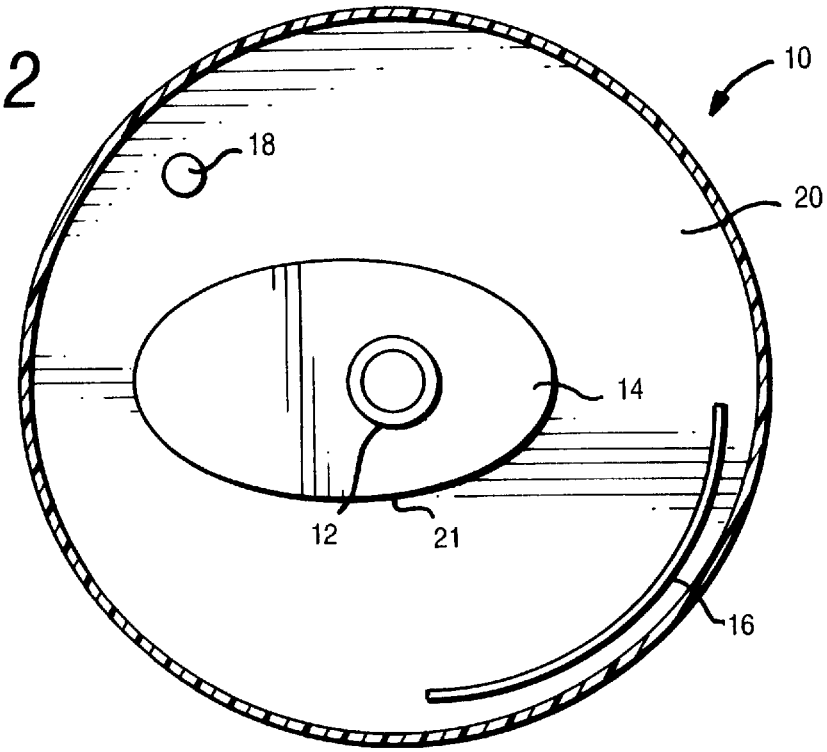
FIG. 2 is a cross-sectional view of a directional antenna displaceable in two discrete positions.

FIG. 2 is a cross-sectional view of a first embodiment directional antenna according to the present invention. The antenna 10 is comprised of a radiator 12 mounted or molded in a first casing 14 for sending and receiving an RF signal. The casing 14 is preferably formed of a moldable material such as a thermal plastic or the like. The radiator is securable to a portable communications device or the like in a conventional manner, and the details thereof will not be further described. A reflector 16, serving, as a shield for EM energy and a director 18, concentrating the EM energy toward a certain direction, are mounted or molded in a second casing 20 formed of a similarly moldable material and having an opening 21 therein defining an inside perimeter. The second casing 20 is preferably selectively engageable with the first casing 14 to provide selective application of the directional structure, including the casing 20, the reflector 16 and the director 18.

In one arrangement, the first casing 14 and the second casing 20 are selectively engageable in concentric relation. Consequently, the casings are rotatable relative to each other. In this context, the positions of the reflector 16 and director 18 relative to the user can be adjusted by rotating the second casing relative to the first casing 14. In one embodiment, as shown in FIG. 2, the outside perimeter of the first casing 14 is formed of a predetermined shape, such as an oval or like shape, and the inside perimeter of the second casing 20 is shaped substantially corresponding to the predetermined shape. In this context, because the casings 14, 20 are formed of a non-conducting moldable material, the tolerance for deviation from shape correspondence is high. With the oval or like shape, the second casing 20 is rotatable relative to the first casing 14 between two discrete positions. That is, the second casing 20 may be disposed in the position illustrated in FIG. 2 or rotated approximately 180° to thereby shift the positions of the reflector 16 and the director 18 relative to the user.

Figure 3:
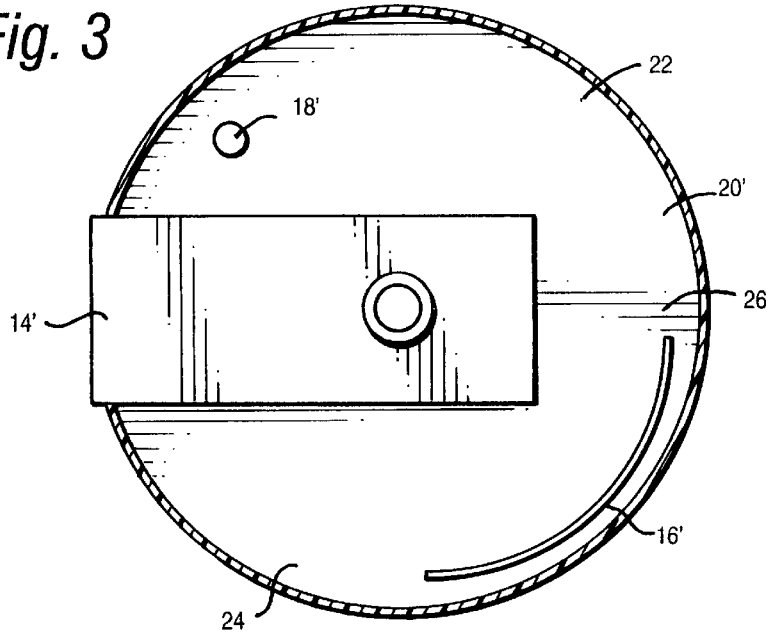
FIG. 3 is a cross-sectional view of a directional antenna in a selectively engaged position.
Figure 4:
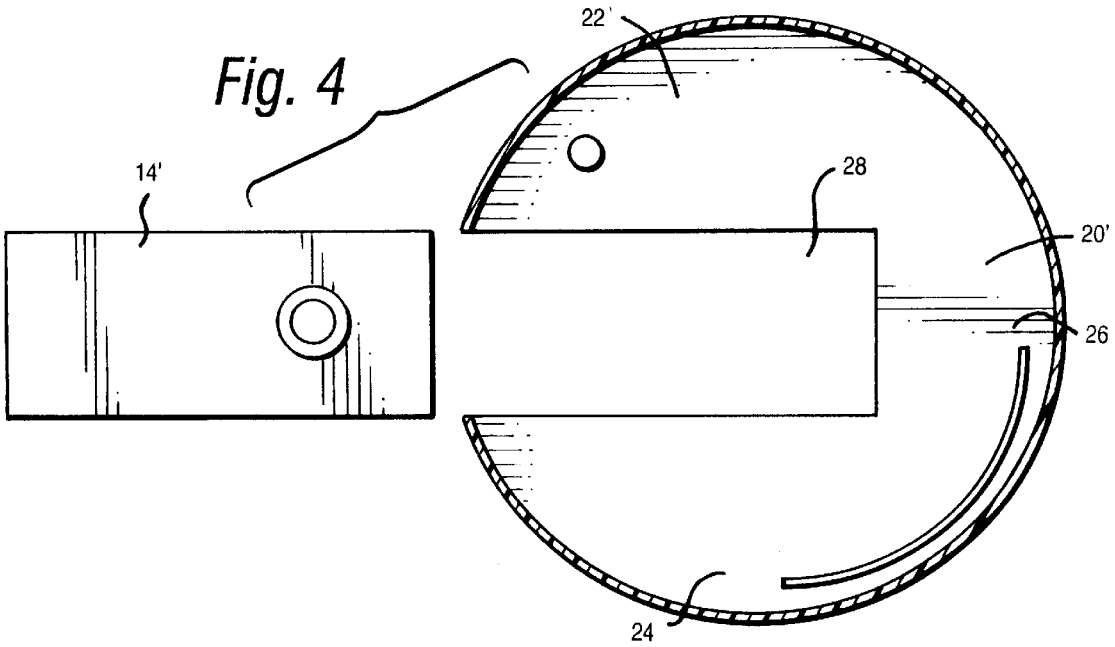
FIG. 4 is a cross-sectional view of the antenna illustrated in FIG. 3 in a selectively disengaged position.

FIGS. 3 and 4 illustrate another embodiment according to the present invention. In this embodiment, the second casino 20' is formed of a soft thermoplastic or the like, which is bendable. The reflector 16' is molded in the second casing 20' and is formed of spring metal sheets. The director 18' is similarly molded in the casino 20 and is formed of metal spring wire. The second casing 20' is substantially U-shaped having sides 22, 24 and a connector 26 between the sides defining an opening 28 therebetween. The first casing 14' is shaped substantially corresponding to the opening 28 in the second casing 20'.

The second casino 20' including the reflector 16' and the director 18' is displaceable between a substantially straight extended position as shown in FIG. 3, in which the second casing 20' is engaged with the first casing 14' such that the reflector 16' and the director 18' are disposed on opposite sides of the radiator, and a bent retracted position as shown in FIG. 4, in which the second casing 20' is disengaged from the first casing 14', thus deactivating the directional structure. In this context, the directional structure defined by the second casing 20', the reflector 16' and the director 18' is selectively engageable with the first casing 14'.

As shown in FIG. 5, the embodiment of the invention illustrated in FIGS. 3 and 4 can be implemented with a communications terminal having a press-button and lock assembly combination to automatically engage the directional structure with the first casing. The press-button and lock combination assembly includes, for example, an activation button 32 such as a PTT (press-to-talk) or a SEND button and a lock member 36 defining opposite sides of a rocking lever. The lever pivots about a central pivot 34, and the lock member 36 is pivoted between an open position when the button 32 is pressed and a locked position when the button 32 is released. When released, the button 32 is urged by suitable urging structure such that the lock member 36 is biased toward the locked position.

The second casing 20' including the directional structure can be secured in the bent retracted position with the lock 36 (as shown in FIG. 5) disengaged with the first casing 14'. When the button 32 is pressed, the lock is deflected to its open position, thereby releasing the second casing 20'. By virtue of the material of the second casing 20', when released, the second casing automatically uncoils to the extended position to engage the directional structure with the antenna radiator.

In an alternative arrangement, an electromagnetic activator is substituted in place of the press-button and lock combination assembly. In this arrangement, the electromagnetic actuator maintaining the second casing 20' in the bent retracted position can be deactivated when the button 32 is pressed, thereby releasing the second casing 20'.

In another alternative application, referring to FIG. 6, the directional structure is disposed in a casing 40 that is displaceable between a retracted position as shown in FIG. 6, and an extended position. In the retracted position, the casing 40 is disposed within the terminal housing 41, and the antenna 42 functions in a conventional manner. A lock assembly 44 of any suitable structure maintains the casing 40 in its retracted position. When the lock assembly 44 is opened to release the casing 40, a spring 46 mounted engaged with the casing 40 urges the casing 40 out of the terminal housing 41 to surround the antenna 42. When the user no longer desires to implement the directional structure, the user deflects the casing 40 against the force of the spring 46 and urges the casing to its retracted position within the terminal housing 41. When the lock assembly 44 is secured, the casing 40 is maintained within the housing 41.

By virtue of the structure according to the present invention, directional antenna structure for improving antenna gain can be selectively engaged and disengaged with the antenna radiator, and the position of the directional structure can be selectively positioned to maximize antenna performance. In this context, the directional structure can be utilized regardless of the position of the terminal relative to the user while maximizing antenna gain.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An antenna for a communications device, comprising:

a radiator mounted in a first casing for sending and receiving an RF signal;

a reflector mounted in a second casing; and a director mounted in said second casing, wherein said first casing and said second casing are independent of each other such that said radiator is not mounted in said second casing, and wherein said first casing and said second casing are selectively positionable relative to each other.

2. An antenna according to claim 1, wherein said second casing comprises a hole therethrough defining an inside perimeter, an outside perimeter of said first casing comprising a predetermined shape, wherein said inside perimeter of said second casing is shaped substantially corresponding to said predetermined shape.

3. An antenna according to claim 2, wherein said first casing and said second casing are rotatable between two discrete positions by virtue of said predetermined shape.

4. An antenna according to claim 3, wherein said predetermined shape is an oval.

5. An antenna according to claim 1, wherein said first casing and said second casing are selectively engageable in concentric relation.

6. An antenna for a communications device, comprising:

a radiator mounted in a first casing for sending and receiving an RF signal;

a reflector mounted in a second casing; and a director mounted in said second casing, wherein said first casing and said second casing are selectively engageable with each other, wherein said radiator is molded in said first casing, and wherein said reflector and said director are molded in said second casing.

7. An antenna for a communications device, comprising:

a radiator mounted in a first casing for sending and receiving an RF signal;

a reflector mounted in a second casing; and a director mounted in said second casing, wherein said first casing and said second casing are selectively engageable with each other, and wherein said second casing is molded from a bendable thermoplastic material, said second casing, said reflector and said director being displaceable between a bent retracted position, in which said second casing is disengaged from said first casing, and a substantially straight extended position, in which said second casing is engaged with said first casing.

8. An antenna according to claim 7, wherein said reflector comprises a spring metal sheet.

9. An antenna according to claim 7, wherein said reflector and said director are molded in said second casing.

10. An antenna for a communications device, comprising:

a radiator mounted in a first casing for sending and receiving an RF signal;

a reflector mounted in a second casing; and a director mounted in said second casing, wherein said first casing and said second casing are selectively engageable with each other, wherein said first casing and said second casing are independent of each other such that said radiator is not mounted in said second casing, and wherein said second casing is substantially U-shaped having sides and a connector between said sides defining an opening therebetween, said first casing being selectively disposed in said opening.

11. An antenna according to claim 10, wherein an outside perimeter of said first casing comprises a predetermined shape, and wherein said opening is shaped substantially corresponding to said predetermined shape.

12. An antenna according to claim 10, wherein said second casing, said reflector and said director are displaceable between a bent retracted position, in which said second casing is disengaged from said first casing, and an extended position, in which said first casing, is disposed in said opening, engaged with said first casing.

13. A communications device, comprising:

a device housing;

a printed circuit board (PCB) mounted in said housing; and an antenna coupled with said PCB, said antenna including:

a radiator mounted in a first casing for sending and receiving an RF signal, a reflector mounted in a second casing, and a director mounted in said second casing, wherein said first casing and said second casing are independent of each other such that said radiator is not mounted in said second casing, and wherein said second casing is selectively displaceable between an engaged position and a disengaged position.

14. A communications device according to claim 13, wherein said second casing, said reflector and said director are displaceable between a bent retracted position, in which said second casing is disengaged from said first casing in said disengaged position, and an extended position, in which said second casing is engaged with said first casing in said engaged position.

15. A communications device according to claim 14, further comprising an activation button secured to the device housing and coupled with the PCB, said actuation button having a lock member coupled therewith, wherein said second casing, said reflector and said director are releasably securable in said bent retracted position by said lock member.

16. A communications device according to claim 15, wherein said actuation button and said lock member define opposite sides of a rocking lever such that when the actuation button is pressed, the lock assembly is deflected from a locked position to an unlocked position, thereby releasing said second casing, said reflector and said director.

17. A communications device according to claim 15, wherein said lock member comprises an electromagnetic actuator, such that when the activation button is pressed, current to the electromagnetic actuator is cut off, thereby releasing said second casing, said reflector and said director.

18. A communications device according to claim 13, wherein said second casing, including said reflector and said director, is displaceable between a retracted position in which said second casing is disposed within said device housing in said disengaged position and an extended position in which said second casing is disposed surrounding said first casing in said engaged position.

19. A communications device according to claim 18, further comprising a lock member secured to said device housing, said lock member being releasably enageable with said second casing to thereby lock said second casing in said retracted position.

20. A communications device according to claim 19, further comprising a spring disposed engaged with said second casing, said spring urging said second casing toward said extended position.

* * * * *